US007230507B2

(12) United States Patent
Kroening

(10) Patent No.: US 7,230,507 B2
(45) Date of Patent: Jun. 12, 2007

(54) COMPACT WAVEGUIDE ISOLATOR

(75) Inventor: Adam M. Kroening, Atlanta, GA (US)

(73) Assignee: EMS Technologies Inc., Norcross, GA (US)

( * ) Notice: Subject to any disclaimer, the term of this patent is extended or adjusted under 35 U.S.C. 154(b) by 0 days.

(21) Appl. No.: 11/391,445

(22) Filed: Mar. 29, 2006

(65) Prior Publication Data

US 2006/0261909 A1 Nov. 23, 2006

Related U.S. Application Data

(62) Division of application No. 10/936,500, filed on Sep. 9, 2004, now Pat. No. 7,049,900, which is a division of application No. 10/289,460, filed on Nov. 7, 2002, now Pat. No. 6,885,257.

(60) Provisional application No. 60/348,194, filed on Nov. 7, 2001.

(51) Int. Cl.
*H01P 1/39* (2006.01)

(52) U.S. Cl. ..... 333/24.2; 333/1.1

(58) Field of Classification Search ..... 333/1.1, 333/24.2

See application file for complete search history.

(56) References Cited

U.S. PATENT DOCUMENTS 6,885,257 B2 * 4/2005 Kroening ..... 333/1.1
7,049,900 B2 * 5/2006 Kroening ..... 333/1.1

FOREIGN PATENT DOCUMENTS

EP 56020301 * 2/1981

* cited by examiner

*Primary Examiner*—Stephen E. Jones
(74) *Attorney, Agent, or Firm*—Hogan & Hartson LLP

(57) ABSTRACT

An improved waveguide isolator that eliminates the transitions to air-filled waveguides between ferrite elements and absorptive load elements is described. The waveguide isolator in accordance with the invention can be implemented in variations from a single ferrite to load transformer held in close proximity to an absorptive load element to any number of ferrite elements and absorptive load elements as required to achieve the desired isolation performance or to create a switch matrix with any combination of input and output ports. The waveguide isolator in accordance with the invention eliminates the transitions between ferrite to load transformers and absorptive load elements and thus reduces component size and mass.

14 Claims, 19 Drawing Sheets

PRIOR ART

PRIOR ART

COMPACT WAVEGUIDE ISOLATOR

CROSS REFERENCE TO RELATED APPLICATIONS

The present application is a Divisional application of U.S. patent application Ser. No. 10/936,500 filed Sep. 9, 2004 now U.S. Pat. No. 7,049,900, which is a Divisional application of U.S. patent application Ser. No. 10/289,460 filed Nov. 7, 2002, which issued as U.S. Pat. No. 6,885,257 on Apr. 26, 2005, which further claims priority from U.S. Provisional Application No. 60/348,194 filed Nov. 7, 2001, all of which are herein incorporated by reference in their entirety.

BACKGROUND OF THE INVENTION

1. Field of the Invention

The invention relates in general to waveguide circulators for the non-reciprocal transmission of microwave energy; and more particularly to a novel system for reducing the size, mass, and insertion loss of the transition from a first circulator to either a second circulator or to a terminating load.

2. Description of the Related Art

Multi-junction waveguide ferrite circulator assemblies have a wide variety of uses in commercial and military, space and terrestrial, and low and high power applications. A waveguide circulator assembly may be implemented in a variety of applications, including but not limited to LNA redundancy switches, T/R modules, isolators for high power sources, and switch matrices. Ferrite circulators are desirable for these applications due to their high reliability, as there are no moving parts required. This is a significant advantage over mechanical switching devices. In most of the applications for multi-junction waveguide switching and non-switching circulators, small size, low mass, and low insertion loss are significant qualities, for example, in satellites where redundancy switches are desired directly behind an antenna array.

A commonly used type of waveguide circulator has three waveguide arms arranged at 120 and meeting in a common junction. This common junction is loaded with a non-reciprocal material such as ferrite. When a magnetizing field is created in this ferrite element, there will be a gyromagnetic effect that can be used as a switching action of the microwave signal from one waveguide arm to another. By reversing the direction of the magnetizing field, the direction of switching between the waveguide arms is reversed. Thus, a switching circulator is functionally equivalent to a fixed-bias circulator but has a selectable direction of circulation. RF energy can be routed with low insertion loss from one waveguide arm to either of the two outputs arms. If one of the waveguide arms is terminated in a matched load, then the circulator acts as an isolator, with high loss in one direction of propagation and low loss in the other direction. Reversing the direction of the magnetizing field will reverse the direction of high and low isolation.

For applications where additional isolation is required between waveguide ports or where additional input/output ports are required, multiple waveguide circulators and isolators are used. The most basic building blocks for multi-junction waveguide circulator networks are single circulator junctions and single load elements, both optimized for an impedance match to an air-filled waveguide interface. For the purposes of this description, the terms "air-filled," "empty," "vacuum-filled," or "unloaded" may be used interchangeably to describe a waveguide structure. The circulators and loads can be connected in various configurations as required for the desired isolation and input/output port configuration. For circulator and isolator junctions, the direction of circulation may either be fixed or switchable.

Conventional waveguide networks comprised of multiple ferrite elements typically have impedance-matching transitions between the ferrite elements. For example, conventional waveguide circulators may transition from one ferrite element to a dielectric-filled waveguide such as a quarter-wave dielectric transformer structure, to an air-filled waveguide, and then back to another dielectric-filled waveguide section and the next ferrite element. The dielectric transformers are typically used to match the lower impedance of the ferrite element to that of the air-filled waveguide. There are several disadvantages to utilizing transformers in such a manner. When dielectric transformers are used, RF losses can be introduced in various ways, such as the following: losses in the dielectric material itself, increased losses in the waveguide surfaces due to the high concentration of RF currents on the metal waveguide surfaces disposed directly above and below the dielectric transformer element, and losses in the adhesives typically used to bond the transformers to the conductive housing.

The use of dielectric transformers also takes up additional space in the waveguide structure. This increases the minimum separation distance that can be obtained in multi-junction assemblies when the input/output ports of multiple circulators are intercoupled to provide a more complex microwave switching or isolation arrangement. This can result in a multi-junction waveguide structure that is undesirably large and heavy.

Just as the standard transitional sections from one ferrite element to another occupy a significant amount of space in traditional multi-junction waveguide circulator networks, so do the transitions from a ferrite element to an absorptive load. These load elements are required to absorb the power that passes through the ferrite element in one direction when the circulator is used as an isolator. Although decreased loss is not an issue for the absorptive load design, decreased size and mass are still desirable attributes of the design.

U.S. Pat. No. 4,697,158 (the '158 patent) discloses one method for decreasing the spacing and loss between the ferrite elements by replacing the standard dielectric transformers with a reduced height waveguide transition. This method removes the transformers, but the reduced height transition is sensitive to dimensional variations, which results in a design that is expensive and difficult to manufacture and assemble. Additionally, the reduced height transition design requires the presence of a significant gap between the ferrite elements, which increases the size of the component.

In view of the problems with the conventional waveguide circulator structures disclosed above, there is a need for a multi-junction waveguide circulator structure with improvements in the critical areas of size, mass, cost, and insertion loss.

SUMMARY OF THE INVENTION

The invention provides a multi-junction waveguide circulator that eliminates the transitions to dielectric transformers and long sections of air-filled waveguide between ferrite elements. Thus, the invention eliminates the transitions out of the ferrite-loaded waveguide found in conventional structures. Instead of using the typical method of transitioning from one ferrite element to a dielectric-filled waveguide to an air-filled waveguide and then back to another dielectric-filled waveguide section and into the next ferrite element, the invention provides a multi-junction waveguide circulator that transitions directly from one ferrite element into the next. The waveguide circulator in accordance with the invention eliminates the loss associated with the dielectric sections and the adhesive used in the assembly of such, and eliminates the additional size and mass required for the dielectric and air-filled waveguide transitional sections.

Furthermore, the configuration of the waveguide circulator in accordance with the invention does not require the additional assembly and tuning steps associated with the dielectric transformers; these steps add additional time and cost to the manufacturing and assembly process. Additional manufacturing and assembly cost savings can be achieved by taking advantage of the close proximity of the ferrite elements and absorptive load elements in this invention. A single magnetizing winding can be shared between multiple ferrite elements, and the absorptive loads can be used in place of the conventional lossy aperture feedthrough elements used for attenuating the undesired RF leakage signal that propagates along the magnetizing windings. These innovations reduce the parts and manufacturing complexity cost.

As will be described in greater detail below in connection with various embodiments of the invention, the invention can be implemented in variations from a minimum of two ferrite circulator elements in close proximity to one another to any number of ferrite elements or loads as required to achieve the desired isolation performance or to create a switch matrix with any combination of input and output ports.

The implementation of the invention requires an analysis of the magnetic bias fields in the ferrite elements to verify that the biasing of one element will not impact the performance of the adjacent element. In accordance with the invention, the size of the ferrite elements at the common location can be increased or a small air gap can be introduced between the ferrite elements in order to prevent this cross talk between the adjacent elements. A similar tradeoff exists when designing a load element in close proximity to the ferrite elements. The load should be designed to be as close to the ferrite element as possible in order to reduce the size and mass of the circulator assembly, but the load should not be so close to the ferrite elements so that it absorbs power that was intended to pass through the circulator, thereby increasing the insertion loss of the design.

The waveguide circulator in accordance with the invention prevents the ferrite-filled waveguide transition from one element to the next from supporting higher order modes, which can result in degraded microwave performance. According to embodiments of the invention, these higher order modes can be eliminated by decreasing the width of the waveguide between the elements, by adding posts connecting the top and bottom waveguide walls, or by other methods of mode suppression. The configuration of the waveguide circulator in accordance with the invention sufficiently suppresses the higher order modes without introducing an impedance mismatch for the propagating mode.

According to one embodiment of the invention, a deminimus gap is provided between the ferrite elements for structural or cross talk elimination purposes. In this embodiment, the gap between the ferrite elements may be on the order of a few thousandths of an inch, and less than 1/10 of a waveguide wavelength at the operating frequency. According to another embodiment of the invention, the ferrite elements are manufactured from a single piece of ferrite, which results in no gap between the ferrite elements. Also, according to embodiments of the invention, the dielectric spacers commonly used to center the ferrite elements along the height of the waveguide can be employed to aid in the assembly of the part, can be used to aid in the transfer of heat out of the ferrite elements in the case of high power designs, or can be eliminated to further reduce the insertion loss of the device. In addition, the invention contemplates that dielectric transformers, reduced height waveguide transitions, or any other standard method of impedance matching can be used at the transitions between the multi-junction ferrite circulator assembly and the input/output waveguide interfaces. It is important to note that the invention can be applied wherever multiple circulator junctions or absorptive load are required. Examples include the following: a switch triad assembly comprised of one switching circulator and two switching or non-switching isolators, a dual redundant LNA assembly comprised of two switch triads and two LNA's, a C-switch/R-switch assembly comprised of four switching circulators and eight switching isolators, and an "i"-to-"j" switch matrix with the number of circulators and load elements dependent on the values of "i" and "j".

The invention also provides a ferrite circulator having one or more ferrite elements, at least one ferrite to load transformer attached to at least a section of the ferrite element and an absorptive load element attached a section of the ferrite to load transformer. Alternatively, there may be a deminimus gap between the absorptive load element and the ferrite to load transformer.

The invention further provides a ferrite circulator having at least one ferrite element, where each ferrite element has a ferrite aperture through at least one ferrite leg, at least one absorptive load element, where each absorptive load element has and absorptive aperture, and a control wire that is threaded through the absorptive aperture and the ferrite aperture allowing for control of the ferrite element. The control wire may be a single continuous wire that passes through adjacent ferrite elements before exiting the waveguide structure which houses the ferrite elements.

The invention also provides a ferrite circulator having at least two ferrite elements, where at least one leg of the each ferrite element has a ferrite aperture and where a control wire is threaded through the ferrite apertures of the two or more adjacent ferrite elements. The control wire may be a single wire that passes through two or more adjacent ferrite elements before exiting the waveguide structure housing the ferrite elements.

Thus, it is an aspect of the invention to provide a multi-junction ferrite circulator that eliminates transitions to dielectric transformers and an air-filled waveguide between ferrite elements.

It is another aspect of the invention to provide a ferrite circulator having at least one ferrite element, whereby the distance between two adjacent and facing legs of the ferrite element is no greater than 1/10 of an operating frequency wavelength for the waveguide circulator.

It is another aspect of the invention to provide ferrite circulator where the junction between two adjacent ferrite elements is a continuous junction having no gap between the adjacent ferrite element legs.

It is another aspect of the invention to provide a waveguide structure which includes at least two opposing boundary walls forming a channel width W2, where the width of a leg of the ferrite element is W1 and were W2 is no greater than 4×W1 and W2 is no less than 2×W1.

It is another aspect of the invention to provide a ferrite circulator having a control wire that is threaded through a channel formed in an absorptive load element, where the control wire is also threaded through at least one ferrite aperture of a ferrite element that is adjacent to the absorptive load element.

It is another aspect of the invention to provide a ferrite circulator having a control wire that is threaded through ferrite apertures of two or more adjacent ferrite elements for controlling the ferrite elements.

It is another aspect of the invention to have a single control wire for controlling the entire ferrite circulator where the single wire passes through two or more ferrite elements before exiting a waveguide structure that houses the ferrite elements.

It is another aspect the invention to provide for ferrite elements have an number of operable shapes, including a Y-shape, a triangular shaped or a cylindrical shape.

It should be understood that both the foregoing general description and the following detailed description are exemplary and explanatory, and provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention. Together with the written description, these drawings serve to explain the principles of the invention. In the drawings.

DETAILED DESCRIPTION OF THE PREFERRED EMBODIMENTS

Figure 1:
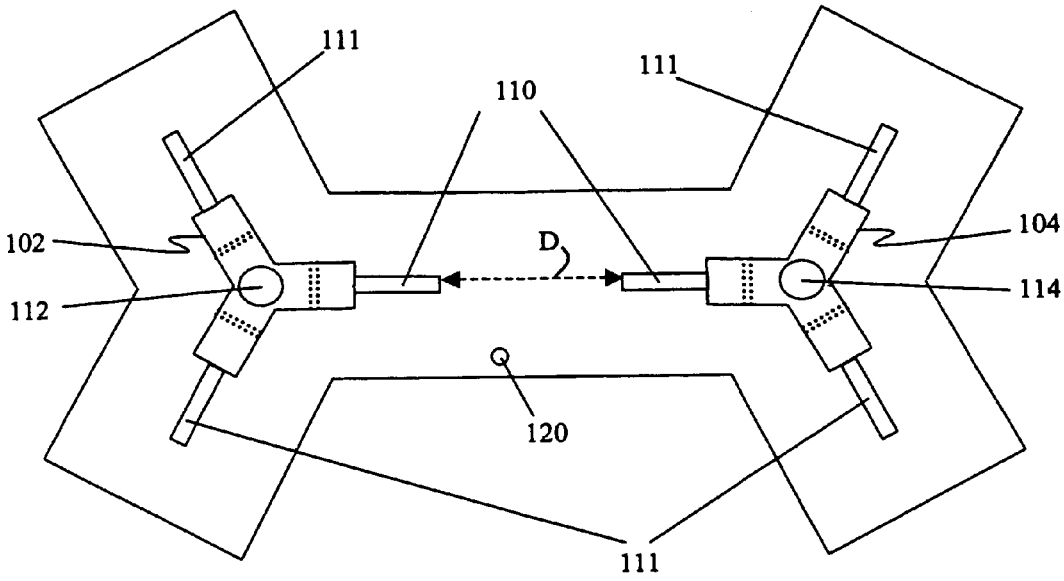
FIG. 1 shows a conventional two-junction waveguide circulator structure.

FIG. 1 is a top view of the interface between two ferrite elements in a conventional two-junction waveguide circulator structure. FIG. 1 shows a first ferrite element 102 disposed adjacent to a second element 104. Each of the ferrite elements 102 and 104 have a quarter-wave dielectric transformer 110 or 111 attached to each leg. There are two transformers 110 attached to the adjacent legs of the ferrite elements and four transformers 111 attached to the remaining legs of the elements. A dielectric spacer 112 is disposed on the top surface of the first element 102 and a dielectric spacer 114 is disposed on the top surface of the second element 104. These dielectric spacers are used to properly position the ferrite elements in the housing and to provide a thermal path out of the ferrite elements for high power applications. Generally, two additional spacers would be used, located underneath the ferrite elements, hidden from view. An empirical matching element 120 is disposed in close proximity to the air gap of distance "D" between the quarter-wave dielectric transformers 110 that attach to adjacent legs of the first and second elements 102 and 104. As shown in FIG. 1, there is a substantial air gap of distance D between the quarter-wave dielectric transformers 110 that are attached to the adjacent legs of elements 102 and 104. This distance D is typically longer than a quarter-wavelength.

Figure 2:
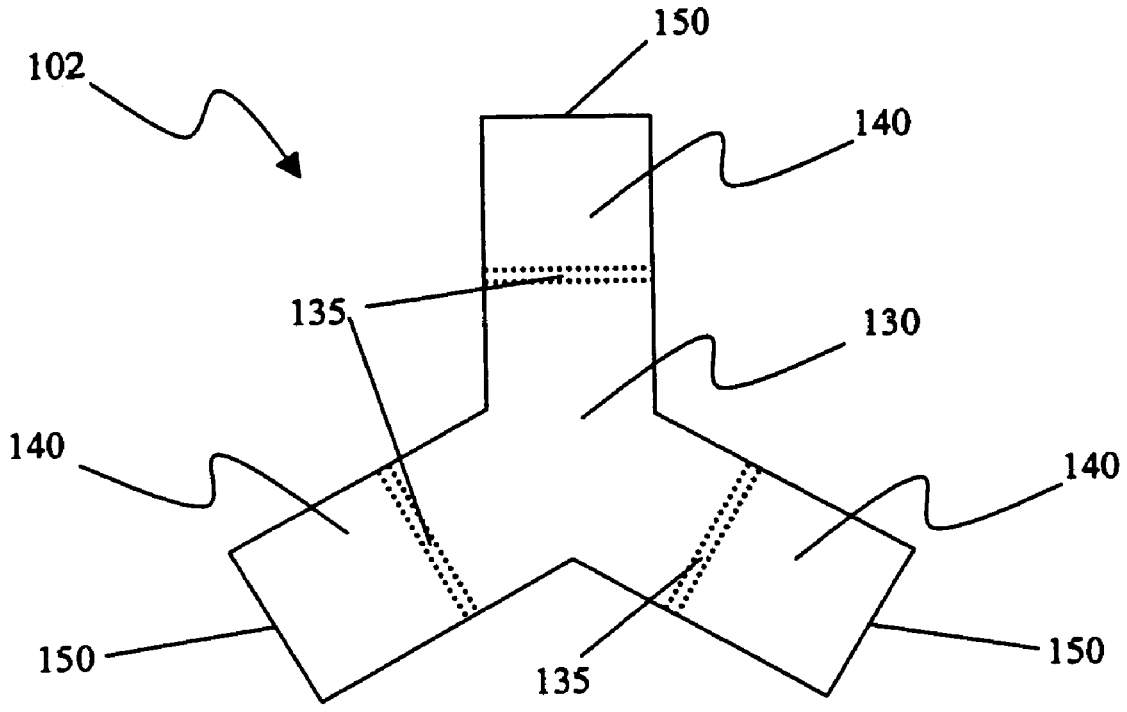
FIG. 2 shows a conventional ferrite element.

FIG. 2 is a ferrite element 102 as used in the conventional structure shown in FIG. 1. This figure is used to define the terminology concerning the ferrite elements. Although magnetizing windings are not shown in this view, dashed lines 135 denote the apertures for the magnetizing windings. These apertures 135 are created by boring a hole through each leg of the ferrite element. If a magnetizing winding is inserted through the apertures, then a magnetizing field can be established in the ferrite element. The polarity of this field can be switched back-and-forth by the application of current on the magnetizing winding to create a switchable circulator. The portion of the ferrite element where the three legs of the element converge and to the inside of the three apertures 135 is the resonant section of the ferrite element 130. The dimensions of this section determine the operating frequency for circulation in accordance with conventional design and theory. The three sections 140 of the ferrite element to the outside of the magnetizing winding apertures 135 act both as return paths for the bias fields in the resonant section 130 and as ferrite quarter-wave transformers out of the resonant section. The faces 150 of the ferrite element are located at the outer edges of the three legs.

Although the exemplary embodiments of the invention are described with respect to a latching circulator switch junction, such as in FIG. 2, the invention can be applied to a fixed circulator junction that uses a current pulse of only one polarity through the magnetizing winding, or to a circulator for which a permanent magnet is used to bias the ferrite element.

Figure 3:
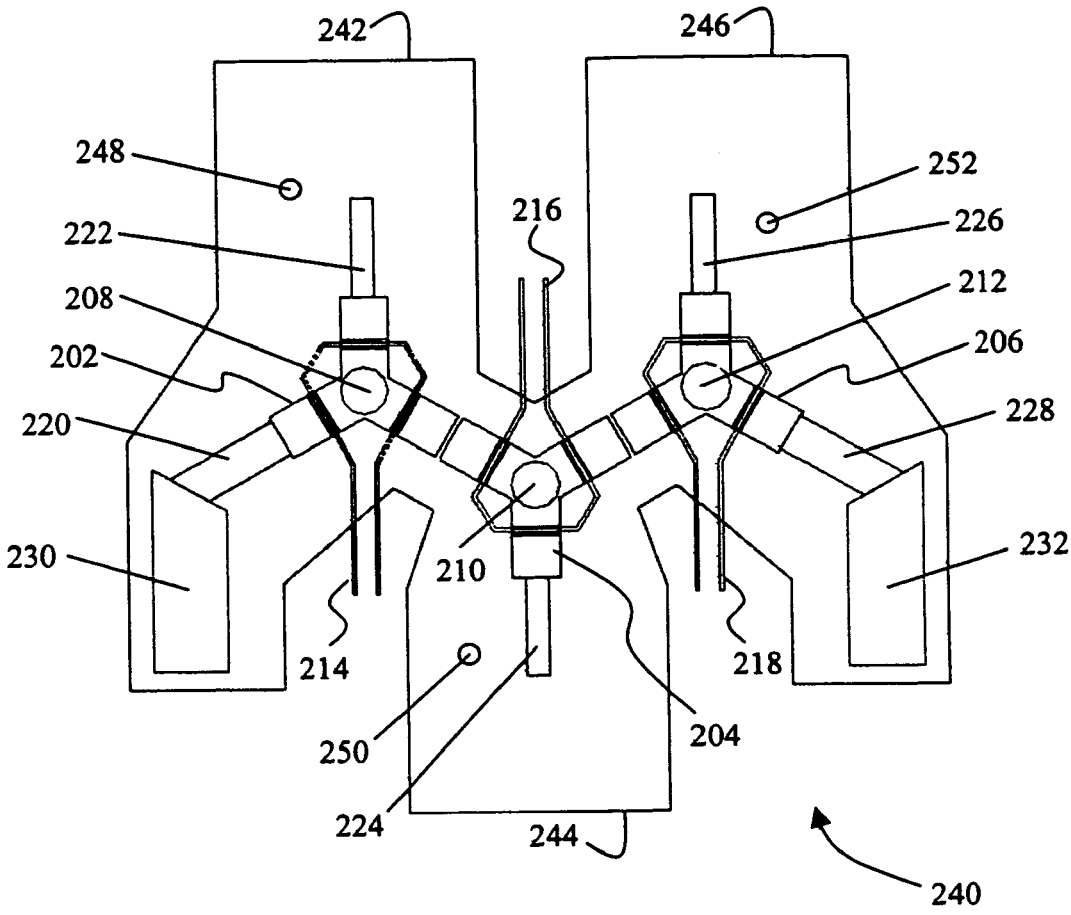
FIG. 3 shows a top view of a multi-junction waveguide circulator utilizing three ferrite elements and two absorptive load elements in accordance with an embodiment of the invention.

FIG. 3 shows a top view of a multi-junction waveguide circulator in accordance with a first embodiment of the invention. This circulator configuration is referred to as a triad switch. A triad switch is comprised of a single switching circulator and two switching or non-switching isolators. The isolators are added to the switch so that the impedance match for any one port is independent of the impedance match on the other ports. Any signal reflections generated by mismatches at the other ports are absorbed in the absorptive load elements that are part of the isolators. It important to note that while the embodiments below illustrate the ferrite element as having a Y-shape with three legs, the invention also includes a variety of differing shapes, including a triangular puck or rectangular puck shape. While these shape may not be considered to have legs as described below, they nevertheless have a particularly protruding portions which may operate in a manner similar to the toroid legs described below.

FIG. 3 shows a conductive waveguide structure 240 that includes three ferrite elements (also called toroids) 202, 204, and 206 configured in a manner so that at least one leg of each ferrite element is adjacent to one leg of a neighboring ferrite element. Each ferrite element 202, 204, and 206 has three legs and has dielectric spacers 208, 210, and 212, respectively, disposed on its outer surface. Apertures are bored through each leg of the ferrite element 202 so that the magnetized winding 214 can be threaded through each leg of the ferrite element 202. Similarly, ferrite elements 204 and 206 have magnetic windings 216 and 218, respectively, threaded through each leg. Alternatively, the magnetic windings may be threaded through at least one of the ferrite element legs, but not necessarily all three. As shown in FIG. 3, the adjacent legs of ferrite elements 202 and 204 are spaced very closely to one another, leaving a de minimus air gap. Similarly, the adjacent legs of ferrite elements 204 and 206 are disposed closely to one another leaving a de minimus air gap.

One leg of each of the ferrite elements 202, 204, and 206 is attached to one quarter-wave dielectric ferrite-to-air transformer 222, 224, and 226 to transition from the ferrite element to the input/output waveguide ports 242, 244, and 246. The ferrite element 202 is attached to a quarter-wave dielectric ferrite-to-air transformer 222. A second leg of the ferrite element 202 is attached to a quarter-wave dielectric ferrite-to-load transformer 220, which in turn is attached to an absorptive load element 230. With the ferrite element connected to the absorptive load element in this manner, the ferrite element acts as an isolator, with low loss in one direction of propagation and high loss in the opposite direction. With the magnetized winding 214 running through the ferrite element 202, the direction of low loss propagation can be switched back and forth, although other embodiments could be implemented with the direction of isolation fixed. The third leg of the ferrite element 202 is adjacent to a leg of the ferrite element 204, and thus is not attached to a transformer. One leg of the ferrite element 204 is attached to a quarter-wave dielectric ferrite-to-air transformer 224. The other two legs of the ferrite element 204 are directly adjacent to legs of the ferrite elements 202 and 206 and thus are not attached to transformers. Like the ferrite element 202, ferrite element 206 also has one leg that is attached to a quarter-wave dielectric ferrite-to-air transformer 226 and one leg that is attached to a quarter-wave dielectric ferrite-to-load transformer 228, which in turn is attached to an absorptive load element 232. Thus, as shown in FIG. 3, there are no ferrite-to-air transformers at the two junctions between adjacent legs of the ferrite elements 202, 204 and 206.

All of the components described above are disposed within the conductive waveguide structure 240. The conductive waveguide structure is generally air-filled. For the purposes of this description, the terms "air-filled," "empty," "vacuum-filled," or "unloaded" may be used interchangeably to describe a waveguide structure. The conductive waveguide structure 240 also includes waveguide input/output ports 242, 244, and 246. The waveguide ports 242, 244, and 246 provide interfaces for signal input and output. As known in the prior art, empirical matching elements 248, 250 and 252 may be disposed on the surface of the conductive waveguide structure 240 to affect the performance. The matching elements are generally capacitive/inductive dielectric or metallic buttons that are used to empirically improve the impedance match over the desired operating frequency band. Each empirical matching element 248, 250, and 252 is disposed near a quarter-wave dielectric ferrite-to-air transformer. Thus, the empirical matching element 248 is disposed adjacent to the quarter-wave dielectric ferrite-to-air transformer 222, the empirical matching element 250 is disposed adjacent to the quarter-wave dielectric ferrite-to-air transformer 224, and the empirical matching element 252 is disposed adjacent to the quarter-wave dielectric ferrite-to-air transformer 226.

In operation as a 1 input/2 output switch, an RF signal is provided as input to the waveguide port 244 and is delivered as output through either waveguide port 242 or 246. The signal enters the waveguide structure 240 through waveguide port 244 and, depending upon the magnetization of ferrite element 204, is directed toward ferrite element 202 or 206. The direction of signal propagation through a ferrite element can be described as clockwise or counter-clockwise with respect to the center of the ferrite element. For example, if the signal input through waveguide port 244 passes in a clockwise direction through ferrite element 204, it will propagate in the direction of the ferrite element 202. For this signal to continue through ferrite element 202 towards port 242, the magnetization of ferrite element 202 should be established so as the propagating signal passes in the counter-clockwise direction with respect to the center junction of ferrite element 202. The RF signal will thereby exit through waveguide port 242 with low insertion loss. Depending on the application for the switch, the magnetization of ferrite element 206 can be established such that an RF signal would propagate in either a clockwise or counter-clockwise direction when waveguide port 246 is not the desired output port. Summarizing the above-described scenario, the RF signal propagates from the input port 244 to the first output port 242 with low insertion loss (effectively ON) and from the input port 244 to the second output port 246 with high insertion loss (effectively OFF).

To change the low loss output port from the first output 244 to the second output 246, a magnetizing current is passed through magnetizing winding 216 so as to cause circulation through ferrite element 204 in the counterclockwise direction. The magnetic bias of ferrite element 206 is established so that the input signal will propagate in a clockwise direction with respect to the center junction of ferrite element 206. This allows the RF signal to propagate from the input port 244 to the second output port 246 with low insertion loss (effectively ON) and from the input port 244 to the first output port 242 with high insertion loss (effectively OFF).

Figure 4:
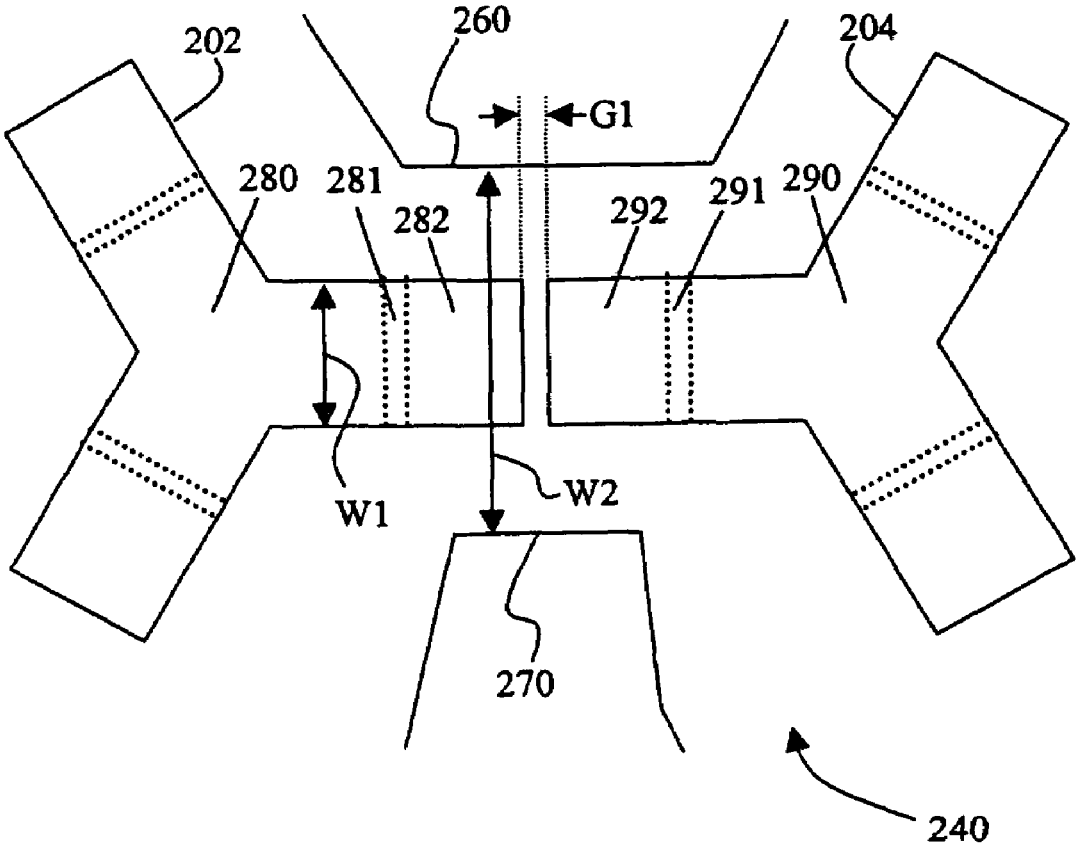
FIG. 4 shows a magnified view of a portion of the multi-junction waveguide circulator of FIG. 3.

FIG. 4 shows a magnified view of a portion of the multi-junction waveguide circulator structure of FIG. 3. The interface between the ferrite elements 202 and 204 is shown in greater detail. As in FIG. 3, FIG. 4 shows a leg of the ferrite element 202 disposed adjacent to a leg of the ferrite element 204. Ferrite element 202 is shown with a resonant section 280, a quarter-wave ferrite section 282, and dashed lines 281 representing an aperture bored through the ferrite element for the magnetizing winding. Ferrite element 204 is shown with a resonant section 290, a quarter-wave ferrite section 292, and dashed lines 291 representing an aperture bored through the ferrite element for the magnetizing winding.

In the conventional designs, as was shown in FIG. 1, additional quarter-wave dielectric ferrite-to-air transformers 110 and a distance D of air-filled waveguide are employed to transition from one ferrite element 102 to a second ferrite element 104. The additional transformer sections 110 do generally improve the frequency bandwidth of a design, but this comes at the cost of increased size, mass, and insertion loss.

Instead of the conventional method of using two two-stage (one ferrite and one dielectric) quarter-wave transformer sections and a section of air-filled waveguide of distance D, which is generally at least a quarter-waveguide wavelength in length, the novel impedance matching approach shown in FIG. 4 requires only the use of the two quarter-wave ferrite sections 282 and 292 and a de minimus length of unloaded waveguide "G1" between the faces of the ferrite elements 202 and 204. The length G1 is a very small fraction of a wavelength, no greater than a tenth of a waveguide wavelength, and on the order of a few thousandths of an inch in the exemplary design for the 27 to 31 GHz frequency range. In contrast, for conventional designs having a frequency range of 27 to 31 GHz, the separation between the faces of the ferrite elements is on the order of 0.5" inches or approximately one hundred times the separation between the faces of length G1 employed in this invention. The length G1 is kept short enough so that the standing waves generated by the impedance mismatches at the ferrite-to-air interfaces effectively cancel each other out. The impedance mismatches at the interfaces between the ferrite resonators 280 and 290 and the ferrite quarter-wave transformer sections 282 and 292, respectively, are separated by a total of a half-wavelength of ferrite-loaded waveguide, so the standing waves generated by these impedance mismatches cancel out as well. Thus, a more compact matching network has been implemented for the microwave signal transition from one ferrite element 202 to a second ferrite element 204.

As stated above, the adjacent legs are located in close proximity to one another so that there is a de minimus air gap of length G1 between them. In this embodiment, the gap serves two purposes. The ferrite elements 202 and 204 are both bonded to the conductive waveguide structure 240. If this multi-junction waveguide circulator is used in a high power application or in an application that sees a wide range of temperatures, differences in the coefficients of thermal expansion between the ferrite elements 202 and 204 and the conductive waveguide structure 240 will stress the adhesive bond lines. Simply stated, the longer the ferrite elements, the higher the stress in the bond lines, and the greater the chances of breaking a bond line or damaging a ferrite element. This de minimus gap between the ferrite elements will minimize the bond-line stress. A second advantage of this de minimus gap is to magnetically isolate the ferrite elements 202 and 204. In this manner, when ferrite element 202 is biased in the desired direction, there will be no crosstalk to affect the magnetic bias fields that are present in the adjacent ferrite element 204, and vise-versa.

By eliminating the conventional quarter-wave dielectric ferrite-to-air transformers and air-filled waveguide section in the transition between two ferrite elements 202 and 204, the resulting matching circuit is essentially a half-wavelength section of ferrite-loaded waveguide. Care must be taken to design this ferrite-loaded waveguide section so that higher order modes cannot propagate and degrade the performance. In FIG. 4, the distance W1 denotes the width of each leg of the ferrite elements 202 and 204. FIG. 4 also shows walls of the waveguide that are adjacent to the ferrite elements. Thus, in FIG. 4, a wall 260 and a wall 270 are disposed in close proximity to the ferrite elements 202 and 204. FIG. 4 also shows a distance W2 that is the distance between opposing walls 260 and 270. The distance W2 must be kept short enough so as to prevent higher order modes from propagating, but also long enough so that the resonant design is not perturbed and so that the half-wavelength section of ferrite-loaded waveguide is still effective in canceling out the standing waves generated by the impedance mismatches at the resonant section-to-quarter-wave ferrite section interfaces.

For the design shown in FIG. 4, the optimal distance W2 was determined empirically, using finite element analysis software. In this design, for the Ka-band of frequency operation, the preferred relationship between distances W1 and W2 is described as follows: W2 is no greater than 4×(multiplied) by W1 and W2 is no less than 2×(multiplied) by W1. However, it is understood that this dimensional relationship can be varied within the scope of the design of this invention, as required for optimum signal transfer with reduced loss and signal reflection.

Figure 5:
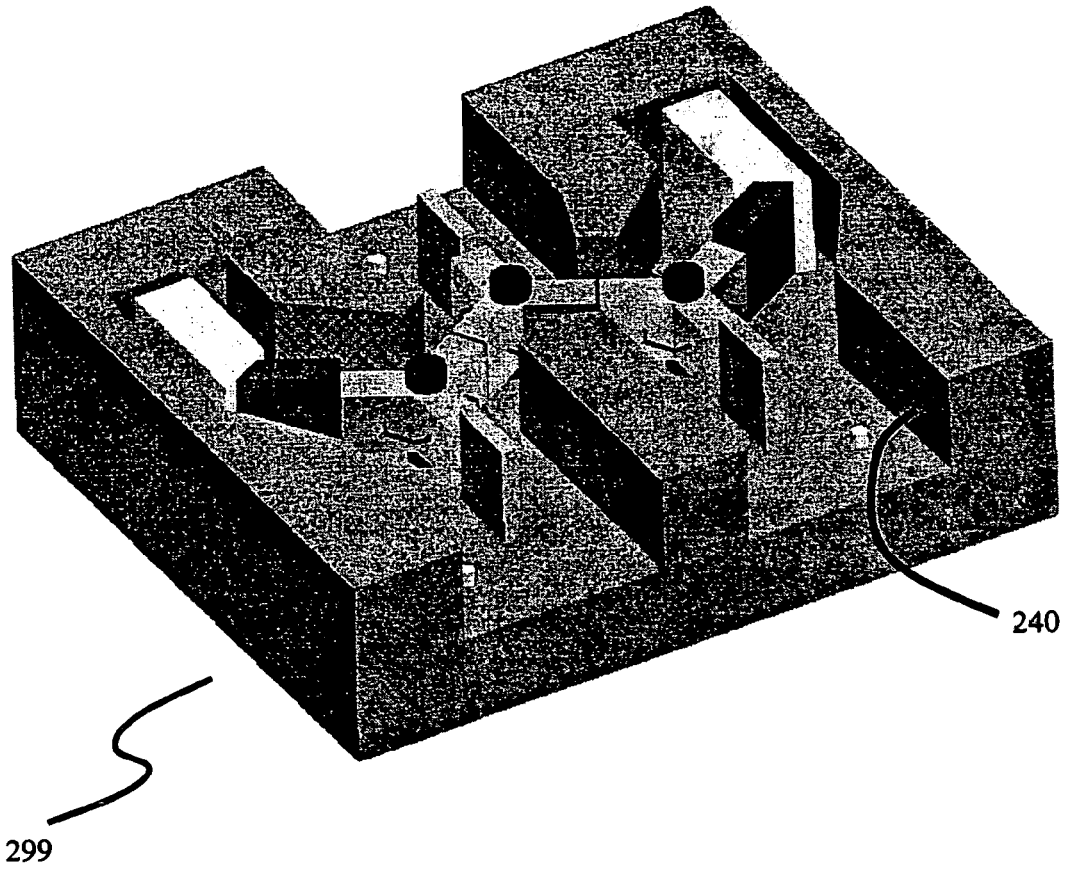
FIG. 5 shows a perspective view of the multi-junction waveguide circulator of FIG. 3 incorporated into a housing.
Figures 6A, 6B, 6C:
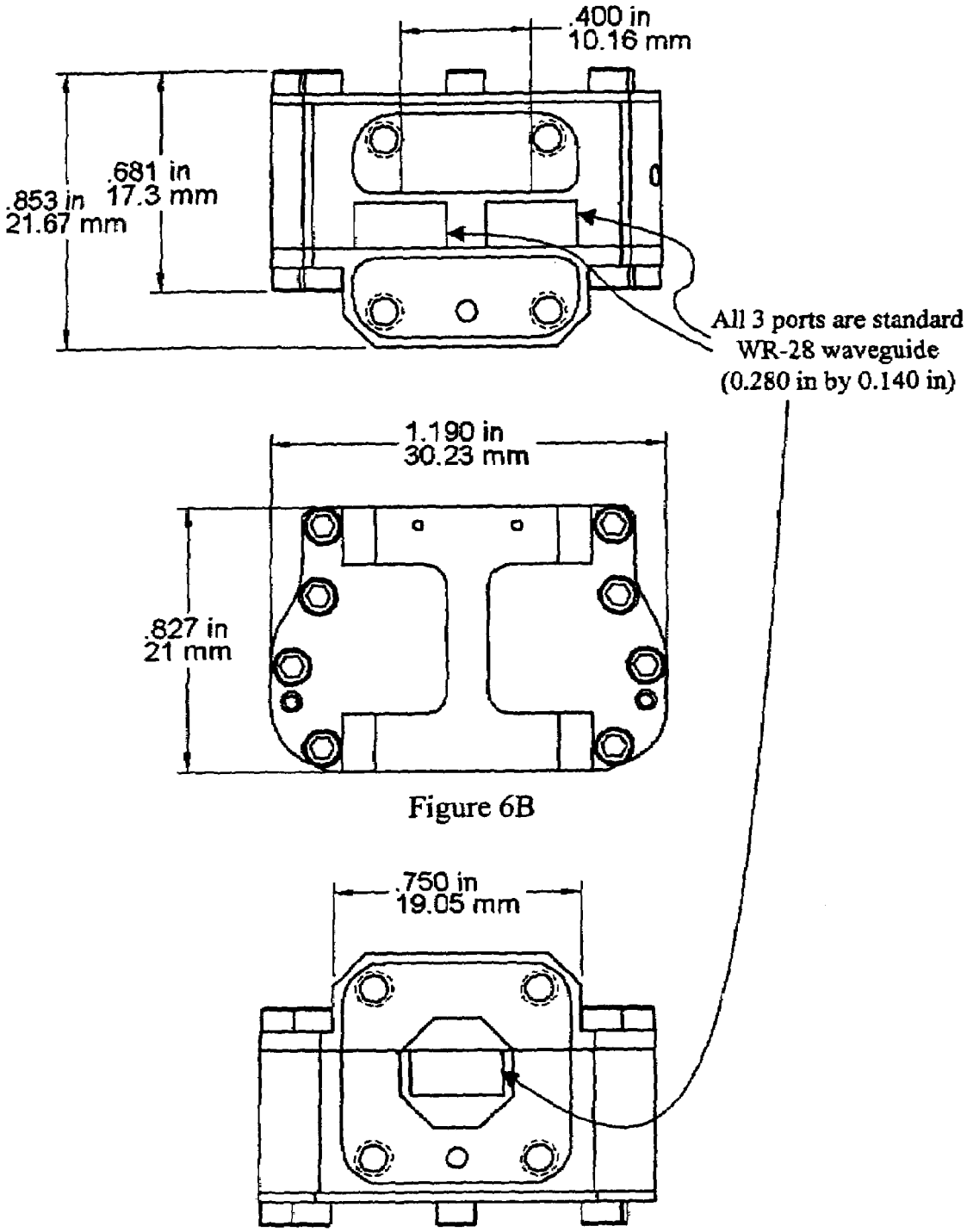
FIGS. 6A, 6B and 6C show outline dimensions (from the front, bottom and rear, respectively) of a prototype design of the multi-junction waveguide circulator of FIG. 3, exemplary of the Ka-band of operating frequency.
Figure 7:
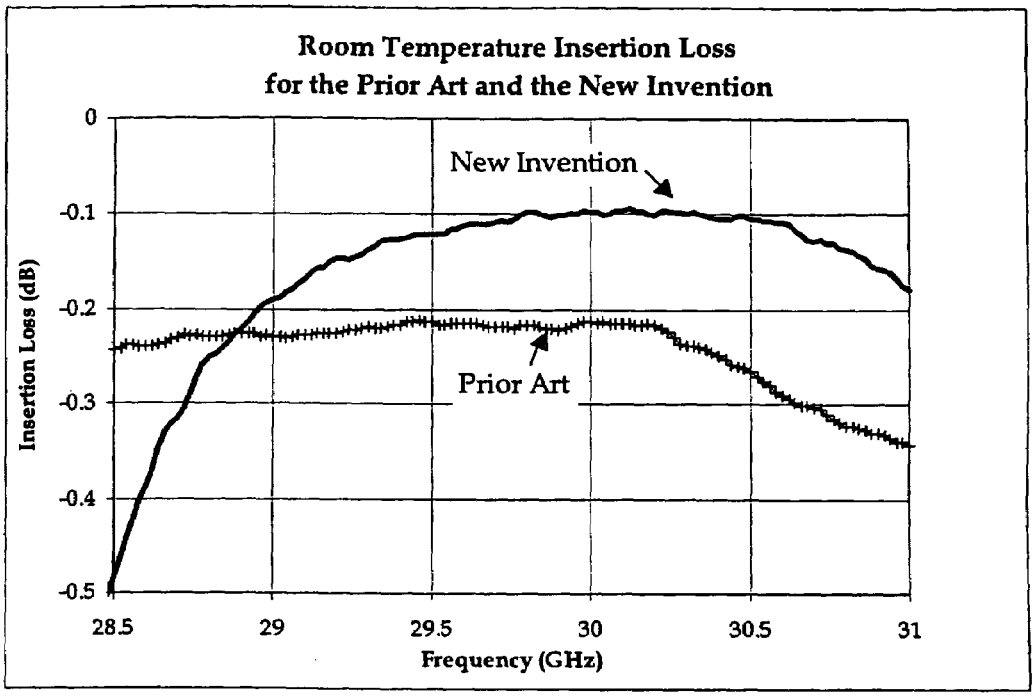
FIG. 7 compares measured data for a prototype of the design shown in FIG. 3 to measured data for a conventional design as shown in FIG. 1, exemplary of the Ka-band of operating frequency.

FIG. 5 shows the conductive waveguide structure 240 of FIG. 3 disposed within a housing 299. The housing 299 provides the conductive waveguide structure 240 and the interfaces for connection to other components. FIG. 6A, 6 B and 6CA show outline dimensions of an example of a design of the multi-junction waveguide circulator of FIG. 3 for the 27 to 31 GHz frequency range. This design is quite compact, with a width of 1.190 inches, a height of 0.853 inches, and a length of 0.827 inches. Measured data for an exemplary prototype of the invention are included in FIG. 7. Measured data for a functionally equivalent multi-junction circulator structure designed using the prior art of FIG. 1 are also shown for comparison. FIG. 7 shows an improvement in room temperature insertion loss from 29.5 to 30.5 GHz of approximately 0.2 dB to 0.1 dB for the invention, resulting from the elimination of the loss associated with the dielectric transformers 110 and the long distance D of air-filled waveguide.

Figure 8:
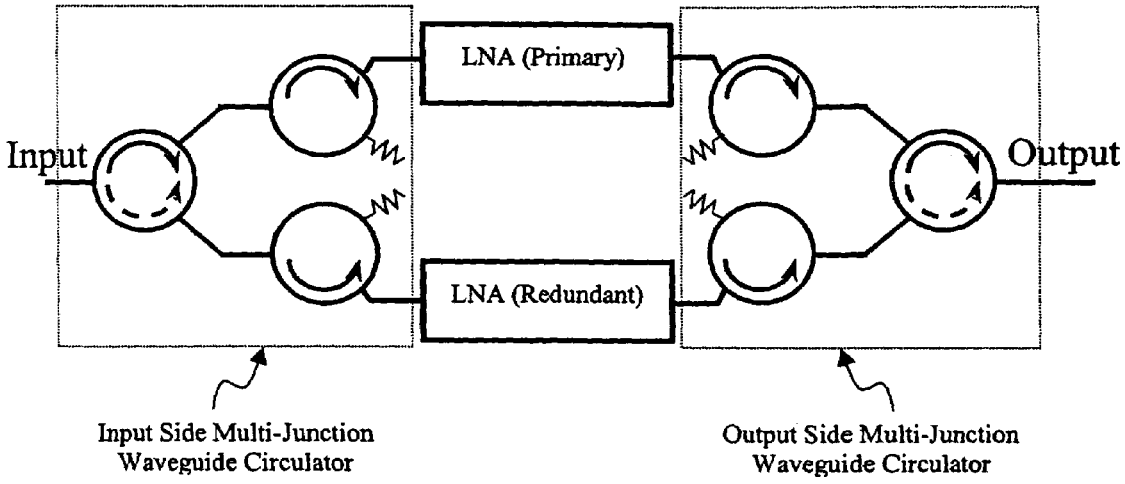
FIG. 8 shows a functional block diagram using two of the multi-junction waveguide circulators of FIG. 3 as the input and output switching mechanisms for primary and redundant LNA's.
Figure 9:
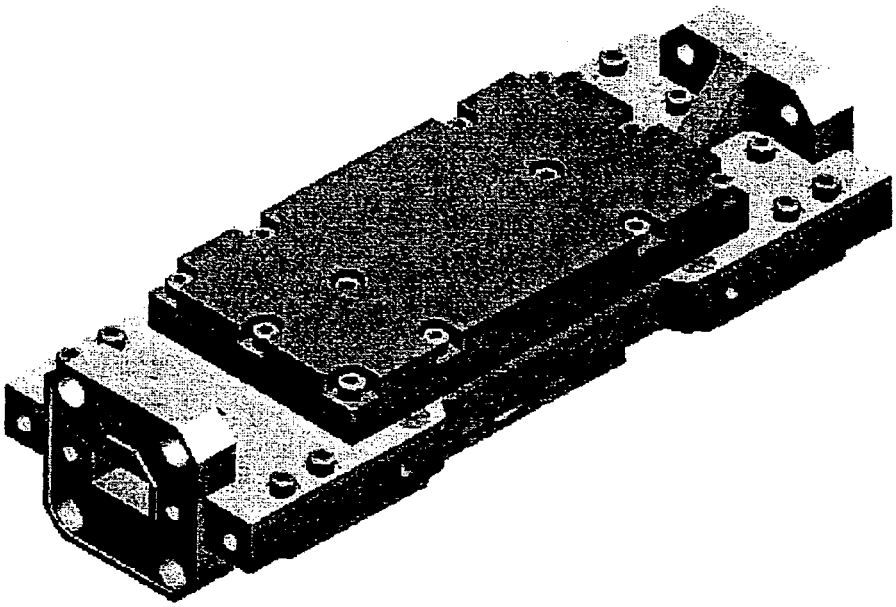
FIG. 9 shows a perspective view of a design following the block diagram of FIG. 8 and using two of the multi-junction waveguide circulators of FIG. 3 as the input and output switching mechanisms for primary and redundant LNA's.

An important application for a compact switch with low insertion loss is for an LNA redundancy switch, as presented in the dual redundant LNA block diagram of FIG. 8. FIG. 9 shows a perspective view of a design following the block diagram of FIG. 8. This design uses two of the multi-junction waveguide circulators of FIG. 3 as the input and output switching mechanisms for primary and redundant LNA's. The low insertion loss of the switch minimizes the noise figure for the LNA, and the small size enables the positioning of the assembly directly behind an antenna array.

Figure 10:
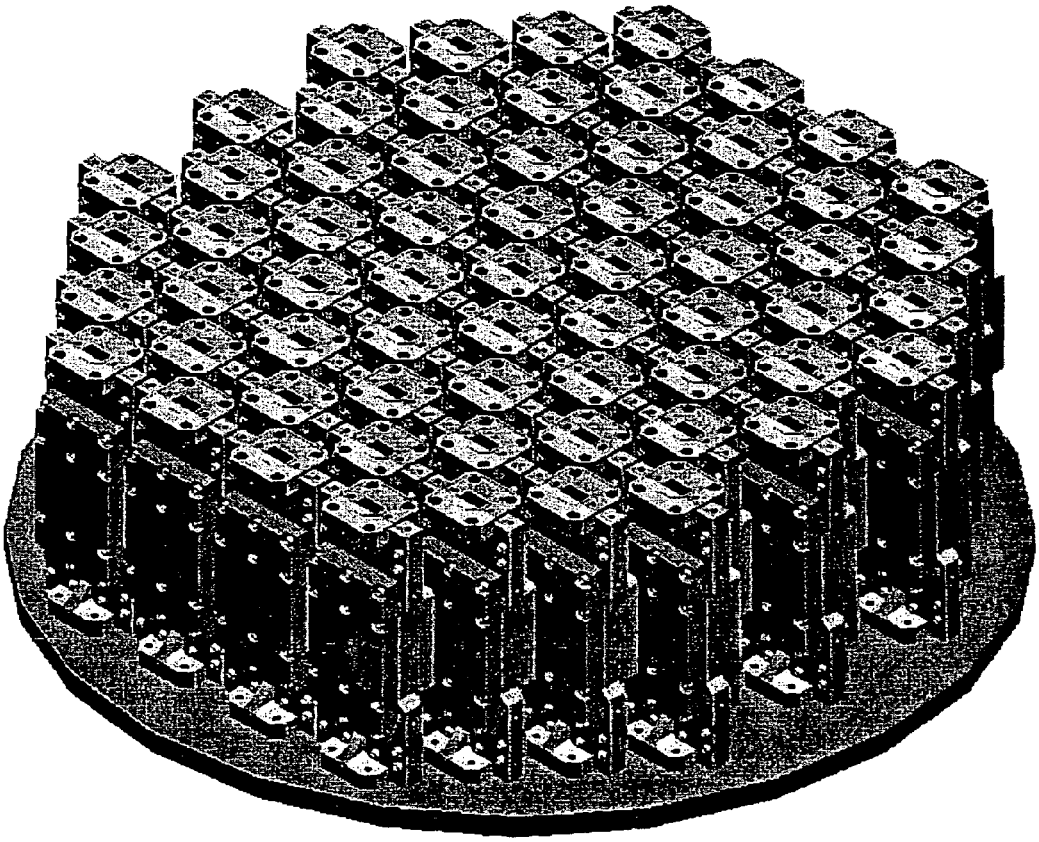
FIG. 10 shows a perspective view of the design following the block diagram of FIG. 8, as it would be used in an application where redundancy switches and LNA's are mounted behind an antenna array.

FIG. 10 shows a perspective view of the design, as it would be used in an application where redundancy switches and LNA's are mounted behind an antenna array.

Figure 11:
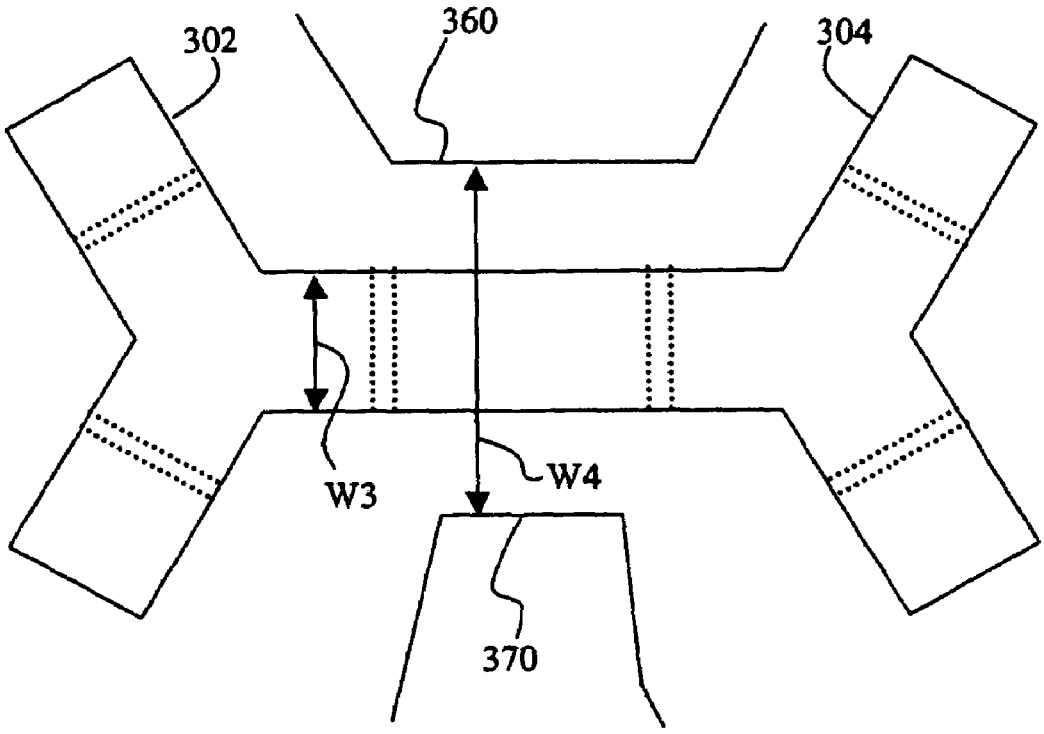
FIG. 11 shows a magnified view of a portion of an alternate embodiment of a multi-junction waveguide circulator.

FIG. 11 shows an alternate embodiment of the multi-junction waveguide circulator. Like FIG. 4, FIG. 11 shows the interface region between ferrite elements. FIG. 11 shows ferrite elements 302 and 304. In this embodiment, the ferrite elements 302 and 304 are made from a single piece of ferrite material. Thus, there is no air gap between the ferrite elements 302 and 304. Although the use of a small air gap has advantages as described above, the use of a single piece of ferrite material for the two ferrite elements 302 and 304 has its own advantages. This eliminates the need for a precise alignment of the individual ferrite elements, thereby eliminating a potential source of standing waves that would not cancel out and that would limit the frequency bandwidth of the device or introduce ripple in the insertion loss of the device.

FIG. 11 shows opposing side walls 360 and 370 for a second embodiment of the invention where W4 is the distance between these walls, and the distance W3 is the width of the legs of the ferrite elements 302 and 304. As in the embodiment of FIG. 4, for the Ka-band of operating frequency the preferred relationship between distances W3 and W4 is described as follows: W4 is no greater than 4×(multiplied) by W3 and W4 is no less than 2×(multiplied) by W3. However, it is understood that this dimensional relationship can be varied within the scope of the design of this invention, as required for optimum signal transfer with reduced loss and signal reflection. Also, in FIG. 4, there is no gap between the contact region between the two adjacent ferrite elements 302 and 304. Instead, as shown in FIG. 11, the two legs of ferrite elements 302 and 304 form a continuous piece that has no discontinuity.

Figure 12:
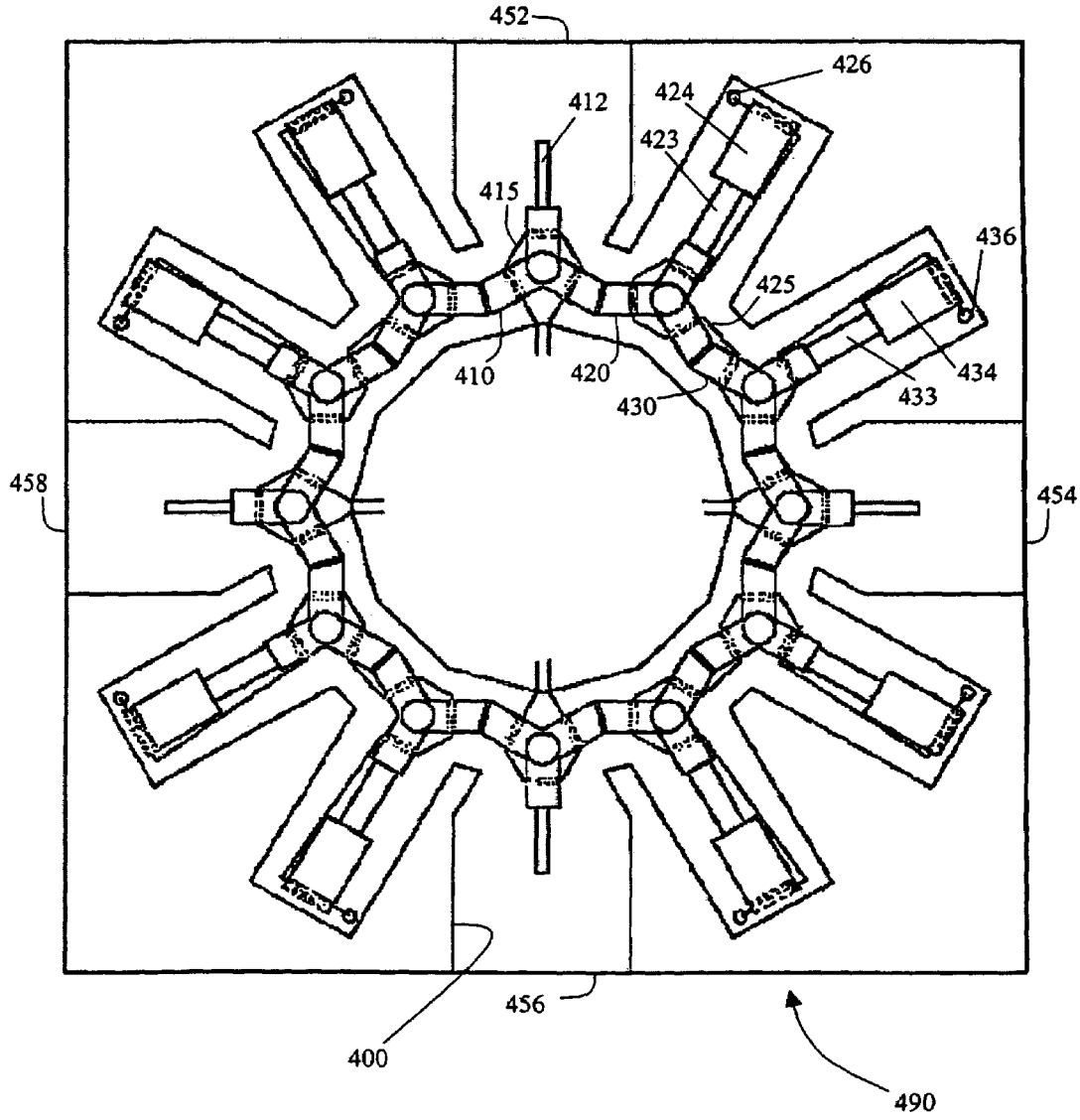
FIG. 12 shows a top view of a multi-junction waveguide circulator utilizing twelve ferrite elements and eight loads in accordance with a another embodiment of the invention.

FIG. 12 shows a third embodiment of a multi-junction waveguide circulator. As was described earlier, the invention can be implemented in variations from a minimum of two ferrite circulator elements to any number of ferrite elements as may be required to achieve the desired isolation performance or to create a switch matrix with any combination of input and output ports. Without the compact size and low loss of this invention, multi-junction waveguide circulators such as that shown in FIG. 12 are not practical. FIG. 12 shows a conductive waveguide structure 400 containing of a plurality of ferrite elements disposed in a circular configuration. A quarter-wave dielectric ferrite-to-air transformer 412 is attached to a leg of ferrite element 410 to assist in the impedance matching between the ferrite element 410 and the input/output port 452. A magnetizing winding 415, also called a control wire, passes through ferrite element 410. Quarter-wave dielectric-to-load transformers 423 and 433 are attached to one leg of ferrite elements 420 and 430, respectively, on one side and to absorptive load elements 424 and 434, respectively, on the other side. A single magnetizing winding 425, enters the conductive waveguide structure 400 through a magnetizing winding aperture 426, which is bored through the floor of the waveguide. The magnetizing winding continues through an aperture bored through the absorptive load element 424, then passes through the three apertures bored through the legs of ferrite element 420, then passes through the three apertures bored through the legs of ferrite element 430, then passes through an aperture bored through the absorptive load element 434, and finally exits the conductive waveguide structure 400 through a magnetizing winding aperture 436 bored through the floor of the waveguide. A similar approach to that described above applies to the remaining components in the multi-junction circulator, but these components have not been labeled for clarity. As with the aforementioned embodiments, the embodiment shown in FIG. 12 transitions directly from one ferrite element to the next without an intermediate dielectric transformer or large air gap, thereby realizing the invention's improvements in size, mass, and loss.

The embodiment of FIG. 12 has examples of some additional innovations in multi-junction waveguide circulators that are possible as a result of the elimination of the additional transformer sections between the ferrite elements. With the ferrite elements spaced in such close proximity, it is feasible to run a single magnetizing winding 425 through multiple ferrite elements 420 and 430 without first exiting the conductive waveguide structure 400. For the embodiment of FIG. 12, four of the magnetizing windings 415 pass through only a single ferrite element 410 as in the prior art, but the other four magnetizing windings pass through two ferrite elements each (only the magnetizing windings 415 and 425 have been labeled for purposes of clarity). This decreases the total number of magnetizing windings required for the assembly by four, resulting in a more efficient and lower cost manufacturing and assembly process. This technique is not possible in the conventional designs due to the microwave performance degradation resulting from running the wires over the long distances between the ferrite elements in the prior art.

A further improvement over the prior art is found in the design of the absorptive load elements 424 and 434. This innovation is analogous to that previously described for the transition between two ferrite elements. The design of the circulator loads has traditionally consisted of two separate steps: impedance matching the circulator to air-filled waveguide and impedance matching the load to air-filled waveguide. A significant (non-de minimus) gap of air-filled waveguide is required between the circulator and load would then be required as used in the prior art. With the inventive approach shown in FIG. 12 (shown but not discussed in FIG. 3 as well), the absorptive load elements 424 and 434 are designed for an optimal impedance match with the waveguide loaded by the quarter-wave dielectric-to-load transformers 423 and 433, and no air gap is required. As with the elimination of the substantial gap between the ferrite elements, the reduction in size in the design of the absorptive load matching circuit comes as a trade-off with frequency bandwidth. By eliminating the additional impedance transformations between the dielectric transformers and the air-filled waveguide and between the absorptive load elements and the air-filled waveguide, the impedance matching network has fewer transformer stages, which decreases the maximum performance bandwidth for the design.

In the many applications where small size and low mass are desirable, elimination of the air-filled waveguide section between the dielectric transformer and the load not only reduces the length of the impedance matching circuit into the load, but it also allows for a reduced waveguide width to be implemented in this section without increasing the cut-off frequency above the desired operating frequency of the absorptive load. This reduction in waveguide width allows for robust walls between the load elements, thereby making the design easier to manufacture and lower in cost to go along with the overall size and mass savings. Another innovative aspect of the absorptive load elements 424 and 434 shown in FIG. 12 is their dual use as absorbers for RF leakage traveling on the magnetizing windings. Because the magnetizing windings must enter and exit the conductive waveguide structure 400 through an aperture bored through the structure, microwave energy can leak out of this same aperture and interfere with other microwave components.

Often, these magnetizing winding apertures are lined with the same lossy material used for the absorptive loads to try to attenuate the RF leakage down to an acceptable level. As shown in FIG. 12, this same feature can be incorporated into the absorptive load elements themselves. For example, the magnetizing winding 425 passes through an aperture in the absorptive load element 434, far enough to the back of the absorptive load element so that the incident microwave energy is sufficiently attenuated. The absorptive load element attenuates any RF leakage propagating on the winding, and the winding exits the circulator structure through a magnetizing winding aperture 436 that does not contain additional lossy material. Analogous to the aforementioned ferrite element wiring innovation, this new technique for absorptive load wiring is practical as a result of minimizing the distance between the ferrite elements and the absorptive load elements. The dual use of the absorptive load element 434 to absorb both the main RF signal and the RF leakage reduces the parts count for the device and allows for the implementation of a magnetizing winding aperture 436 that is easier to manufacture. Through this innovation, the location and orientation of the magnetizing winding aperture 436 are no longer critical as the aperture is located in a region of relatively low microwave energy, resulting in a lower cost device that can be manufactured at a higher rate.

Figure 13:
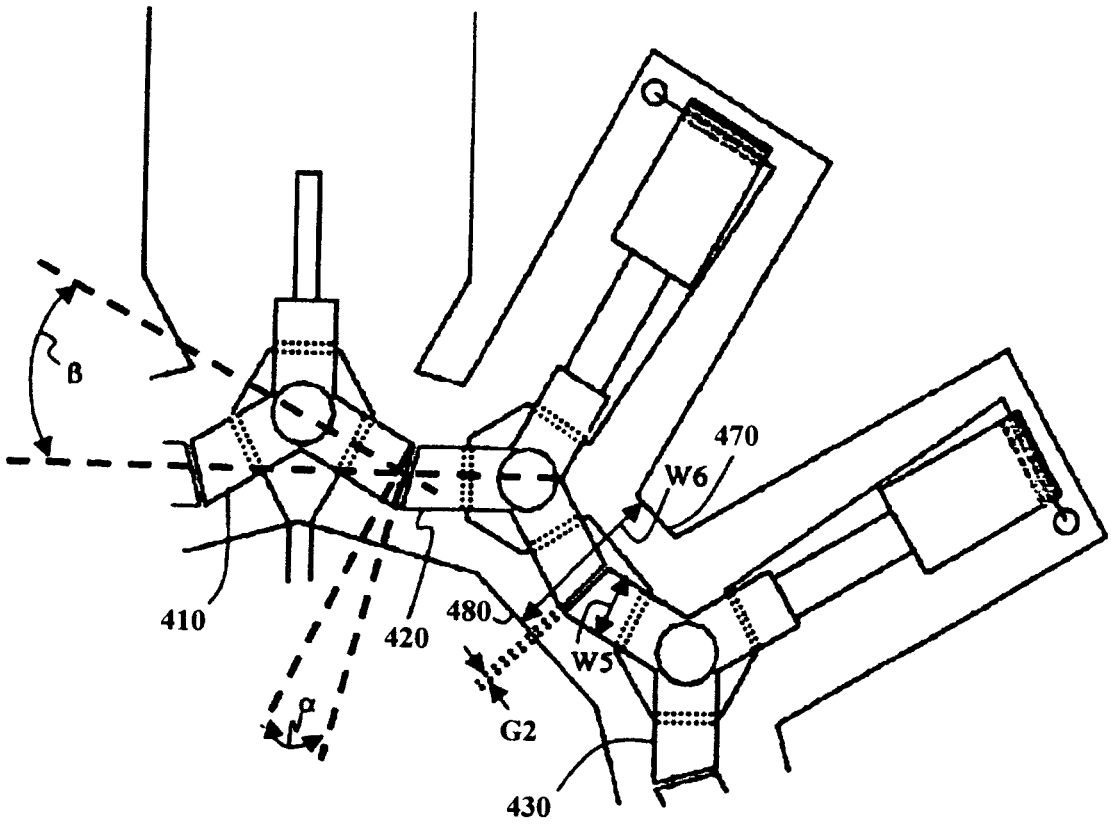
FIG. 13 shows a magnified view of a portion of the multi-junction waveguide circulator of FIG. 12.

A final innovation of the embodiment of FIG. 12 is shown in greater detail in FIG. 13. FIG. 13 shows a magnified view of a three-ferrite element segment of the multi-junction waveguide circulator of FIG. 12. As in FIG. 4, the gap of length "G2" between the ferrite elements is a very small fraction of a wavelength. G2 is no greater than a tenth of a waveguide wavelength, and on the order of a few thousandths of an inch in the exemplary design for the 27 to 31 GHz frequency range. FIG. 13 shows opposing side walls 470 and 480 where the distance between the side walls 470 and 480 is W6. FIG. 13 also shows that the length W5 represents the width of the leg of the ferrite element 430. For an exemplary case in the Ka-band of frequency from 27 to 31 GHz, the preferred relationship between distances W5 and W6 is approximated by the following expression: W6=3*W5. However, it is understood that this dimensional relationship can be varied within the scope of the design of this invention, as required for optimum signal transfer with reduced loss and signal reflection.

As with the embodiment shown in FIG. 4, the adjacent faces of the ferrite elements 420 and 430 are parallel to one another, with a constant gap of length G2 between them. The difference in the transition shown in FIG. 13 is that the adjacent faces of the legs of the ferrite elements 420 and 430 are not normal to the axis of the leg. In FIG. 4, the axes of the adjacent legs of the ferrite elements 202 and 204 are in line and parallel to one another, and the adjacent faces are normal to the axes of the legs and parallel to one another. In FIG. 13, the faces are beveled at an angle "a" of 7.5° from normal with respect to the axis of the leg. This results in an angle "b" of 15° in the line between the axes of the legs of two adjacent ferrite elements. This angle "b" is necessary to keep the adjacent faces parallel while constrained to the geometry of a closed circle of twelve ferrite elements, each with three legs separated by 120°. By keeping the faces of the two ferrite elements parallel to one another with a de minimus air gap, a 15° degree mitered bend has been incorporated into the half-wavelength section of ferrite-loaded waveguide that separates the resonant sections of the two ferrite elements 420 and 430. Without this innovation, a compact multi-junction waveguide circulator as shown in FIG. 12 would not be possible either due to the limits of geometry in keeping the axes of the legs of the ferrite elements in line or due to the limits of performance from the impedance mismatches at the interfaces between the adjacent ferrite elements.

Figure 14:
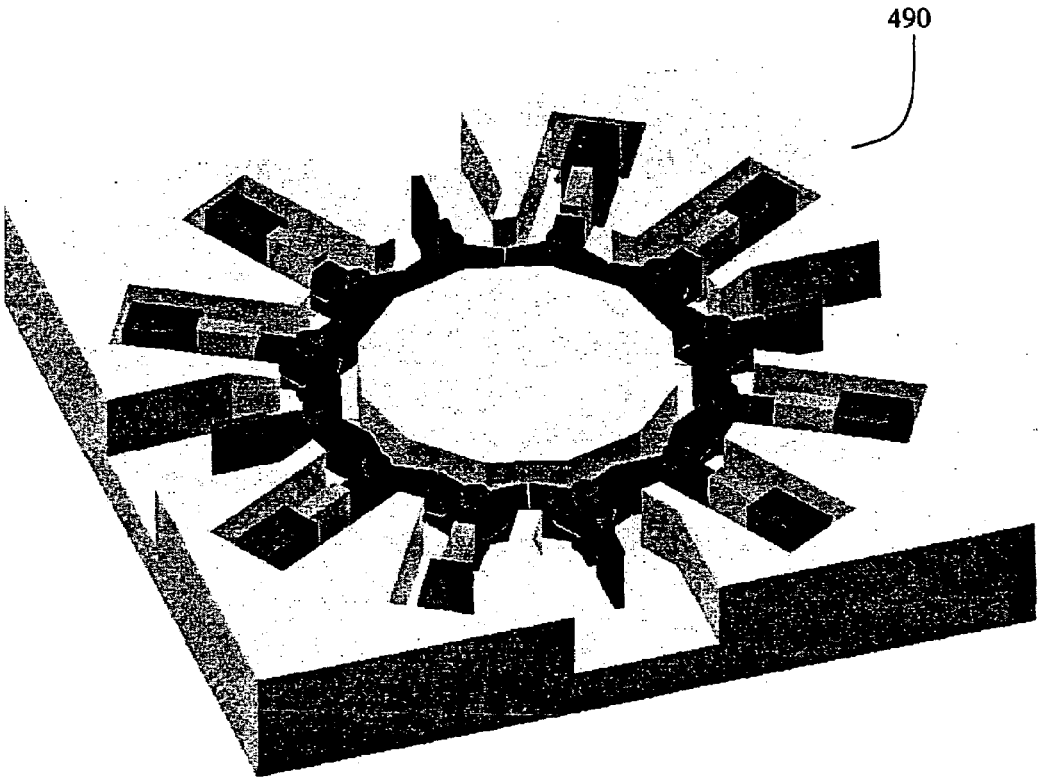
FIG. 14 shows a perspective view of the multi-junction waveguide circulator of FIG. 12 incorporated into a housing.

FIG. 14 shows a perspective view of the multi-junction waveguide circulator shown in FIG. 12 within a housing 490. The circulator arrangement presented in these figures is significant in that it allows for the emulation of the functionality of a mechanical "R" or "C" transfer switch without any of the moving parts that limit the reliability of mechanical switches, and with high isolation from the switch outputs back to the switch inputs.

Figure 15:
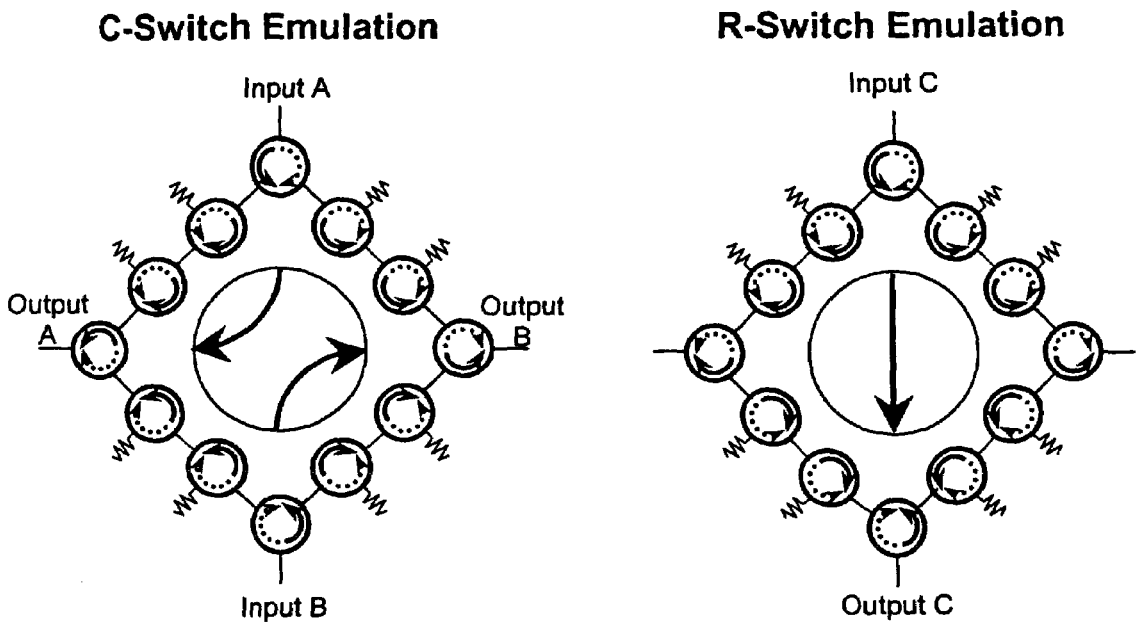
FIG. 15 shows two functional block diagrams of the multi-junction waveguide circulator of FIG. 12.

FIG. 15 shows the functional block diagrams for this switch matrix in the "C" and "R" configurations. A symbol for the switching circulator represents each of the twelve ferrite elements in the ring of elements shown if FIG. 12. For the C-Switch Emulation diagram in FIG. 15, Input A, Output A, Input B, and Output B are equivalent to the ports labeled 452, 458, 456, and 454, respectively, in FIG. 12. For the R-Switch Emulation diagram in FIG. 15, Input C and Output C are equivalent to the ports labeled 452 and 456, respectively, in FIG. 12. For both the C and R switch emulations, the switching circulators and isolators can be controlled so that any of the four ports acts an input port and any of the four ports acts as an output port.

In C-switch emulation, energy incident to Input A propagates with low insertion loss (effectively ON) to Output A and with high insertion loss (effectively OFF) to the other two ports. Energy incident to Input B propagates with low insertion loss (effectively ON) to Output B and with high insertion loss (effectively OFF) to the other two ports. Energy incident to Output A or Output B propagates with high insertion loss (effectively OFF) to all ports. In R-switch emulation, energy incident to Input C propagates with low insertion loss to Output C and with high insertion loss (effectively OFF) to all other ports. Energy incident to any port other than Input C propagates with high insertion loss (effectively OFF) to all ports.

Figure 16:
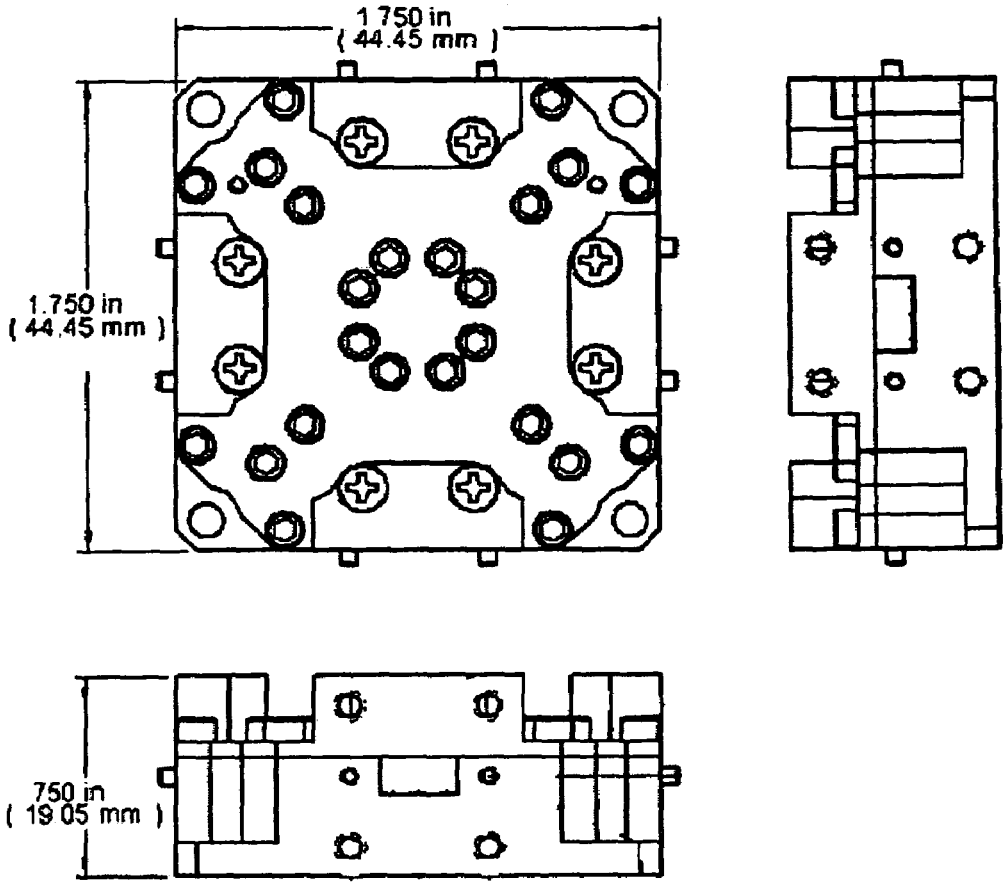
FIG. 16 shows outline dimensions of a prototype design of the multi-junction waveguide circulator of FIG. 12.
Figure 17:
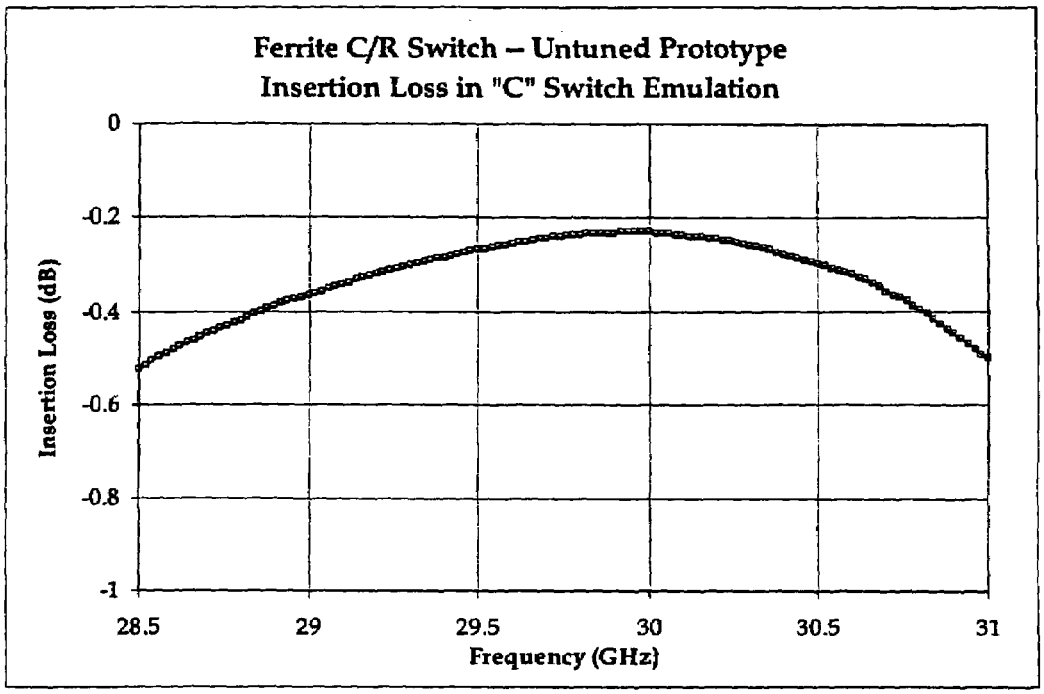
FIG. 17 shows measured data for a prototype of the multi-junction waveguide circulator of FIG. 12 for the Ka-band of operating frequency.

Without the innovations presented herein, the size and insertion loss of a multi-junction waveguide circulator assembly consisting of twelve ferrite elements and eight absorptive load elements would be prohibitive to any consideration over a mechanical switch. The design presented in FIG. 12, however, is approximately the same size as a mechanical switch. For operation from 27 GHz to 31 GHz in the Ka-band of frequency with standard WR-28 waveguide ports, the outline dimensions of the exemplary design are 1.75" long by 1.75" wide by 0.75" tall, as shown in FIG. 16. FIG. 17 shows measured room temperature insertion loss from 28.5 to 31 GHz for an exemplary prototype of this design in the "C" switch configuration.

Figure 18:
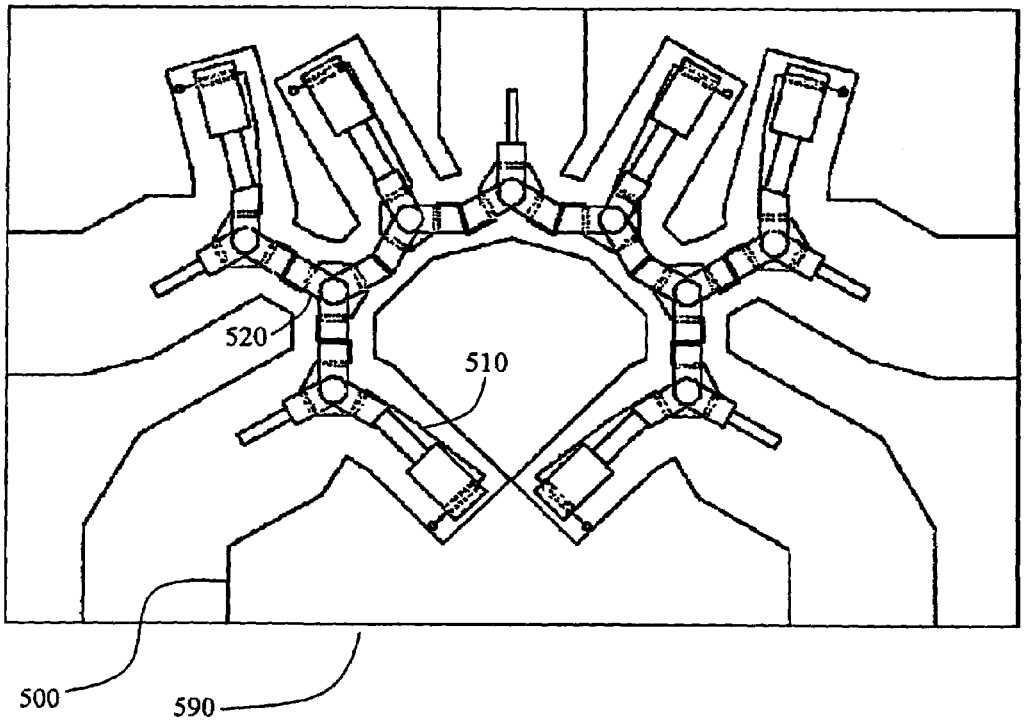
FIG. 18 shows a top view of a five-port, multi-junction waveguide circulator utilizing nine ferrite elements and six loads in accordance with another embodiment of the invention.

FIG. 18 shows a top view of a five-port, multi-junction waveguide circulator utilizing nine ferrite elements and six loads in accordance with a fourth embodiment of the invention. This design could be used as a one input/output to four output/input switch. Many of the features shown in the FIG. 18 design are similar to the others designs presented herein, so a detailed description will not repeated. Some of these features are utilized in a slightly different manner, providing some insight into the many embodiments that are possible with this invention. Ferrite element 520 combines some of the features of earlier embodiments of the invention. Two of the legs of ferrite element 520 have faces normal to the axes of the legs and are adjacent to ferrite elements separated by a de minimus gap, and a third leg has a face that is beveled and is adjacent to a ferrite element with a similarly beveled face. This design is an example of how the novel design approach employing a de minimus gap between ferrite elements can be applied to all three legs of a ferrite element and how the geometry of the three legs does not have to be uniform. The FIG. 18 design also shows how the wiring innovations can be extended. The magnetizing winding 510 is shown passing through two load elements and three ferrite elements in this design.

Figure 19:
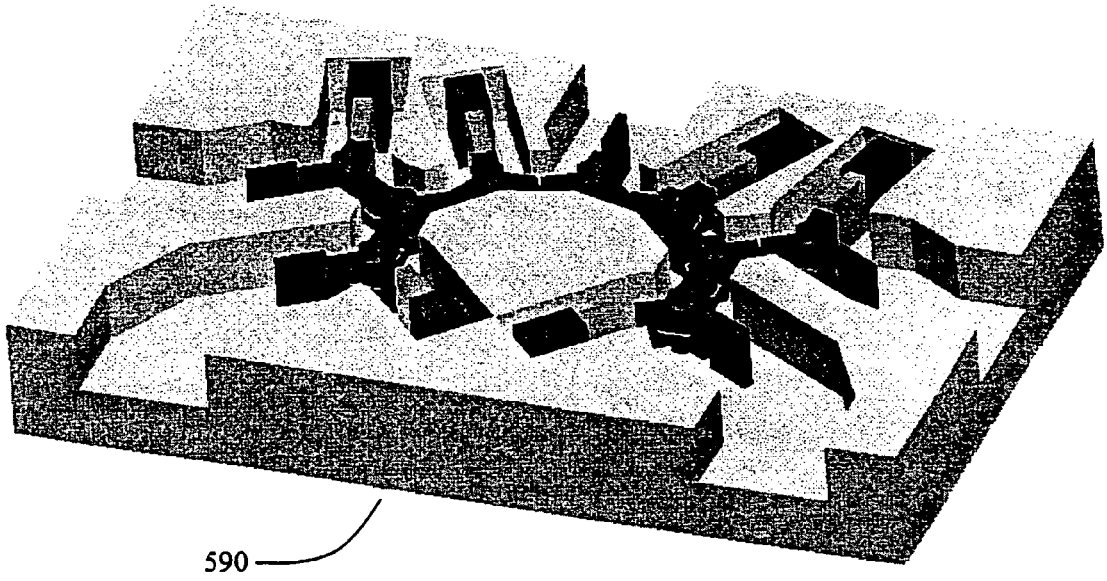
FIG. 19 shows a perspective view of the multi-junction waveguide circulator of FIG. 18 in a housing.

FIG. 19 shows a perspective view of the FIG. 18 embodiment in a waveguide enclosure 590. The utilization of these novel design innovations for a four-to-one switch provides significant size and mass savings over the traditional design. The operating frequency bandwidth is not as wide as in the traditional design, but the in-band insertion loss is much lower due to the reduction in parts and size. Most importantly, the design of FIG. 18 is on the order of 25% of the mass and size of the equivalent design employing the prior art.

It will be apparent to those skilled in the art that various modifications and variations can be made to this invention without departing from the spirit or scope of the invention. Thus, it is intended that the present invention covers the modifications and variations of this invention provided that they come within the scope of any claims and their equivalents.

The invention claimed is:

1. A ferrite circulator, comprising:

a waveguide structure having an internal cavity, the waveguide structure including a plurality of ports extending from the internal cavity;

at least one ferrite element disposed in the internal cavity, at least one ferrite to load transformer attached to at least one leg of the at least one ferrite element; and at least one absorptive load element disposed adjacent the at least one ferrite to load transformer, the at least one absorptive load element having a first surface, the at least one ferrite to load transformer having a second surface, wherein a de minimus gap is formed between the first and second faces.

2. The ferrite circulator according to claim 1, wherein the de minimus gap consists of an air gap.

3. The ferrite circulator according to claim 1, wherein the de minimus gap is no greater than 1/10 of a waveguide wavelength at an operating frequency.

4. The ferrite circulator according to claim 1, wherein the de minimus gap includes an adhesive material.

5. The ferrite circulator according to claim 1, wherein the de minimus gap is a dielectric.

6. The ferrite circulator according to claim 1, further comprising at least one of a dielectric spacer and a conductive spacer disposed on an outer surface of the at least one ferrite element.

7. The ferrite circulator according to claim 1, further comprising at least one empirical matching element disposed within the internal cavity.

8. The ferrite circulator according to claim 1, further comprising a single control wire, wherein the ferrite circulator comprises a plurality of ferrite elements disposed in the internal cavity, at least two of the plurality of ferrite elements being adjacent to one another, and the at least two adjacent ferrite elements having at least one ferrite aperture each so that the single control wire is threaded through the at least two adjacent ferrite elements via the at least one ferrite aperture to control the plurality of ferrite elements.

9. The ferrite circulator according to claim 8, wherein the waveguide structure has no more than two openings for passing the control wire.

10. The ferrite circulator according to claim 9, wherein the control wire does not exit the waveguide structure until it passes through the at least two adjacent ferrite elements.

11. The ferrite circulator according to claim 1, wherein the at least one ferrite element has at least one ferrite aperture and the at least one absorptive load element has an absorptive aperture so that a control wire threaded through the absorptive aperture and the at least one ferrite aperture controls the at least one ferrite element.

12. The ferrite circulator according to claim 11, wherein the waveguide structure has no more than two openings for passing the control wire.

13. The ferrite circulator according to claim 11, further comprising at least one adjacent ferrite element having at least one ferrite aperture, wherein the control wire is threaded through the at least one ferrite aperture of the adjacent ferrite element.

14. The ferrite circulator according to claim 13, wherein the control wire does not exit the waveguide structure until it passes through the at least one ferrite element and the adjacent ferrite element.

* * * * *